US010013936B2

(12) United States Patent
Ahn et al.

(10) Patent No.: US 10,013,936 B2
(45) Date of Patent: Jul. 3, 2018

(54) GAMMA VOLTAGE GENERATION CIRCUIT OF SOURCE DRIVER

(71) Applicant: SILICON WORKS CO., LTD, Daejeon-si (KR)

(72) Inventors: Yong Sung Ahn, Ansan-si (KR); Jung Min Choi, Daejeon-si (KR)

(73) Assignee: SILICON WORKS CO., LTD, Daejeon-si (KR)

( * ) Notice: Subject to any disclaimer, the term of this patent is extended or adjusted under 35 U.S.C. 154(b) by 185 days.

(21) Appl. No.: 14/522,421

(22) Filed: Oct. 23, 2014

(65) Prior Publication Data

US 2015/0042546 A1 Feb. 12, 2015

Related U.S. Application Data

(63) Continuation-in-part of application No. 13/008,332, filed on Jan. 18, 2011, now abandoned.

(30) Foreign Application Priority Data

Jan. 19, 2010 (KR) ..... 10-2010-0004661

(51) Int. Cl.
*G09G 3/36* (2006.01)

(52) U.S. Cl.
CPC ..... *G09G 3/3614* (2013.01); *G09G 3/3685* (2013.01); *G09G 3/3696* (2013.01); *G09G 2300/08* (2013.01); *G09G 2310/027* (2013.01); *G09G 2310/0254* (2013.01); *G09G 2310/0291* (2013.01); *G09G 2320/0276* (2013.01); *G09G 2330/028* (2013.01)

(58) Field of Classification Search
CPC ..... G09G 3/3688; G09G 3/3614; G09G 2320/0252; G09G 2310/0297; G09G 2310/0291; H03F 3/3022; H03F 3/45183; H03F 3/4521; H03F 3/45753; H03F 2203/45534; H03F 2203/45726; H03F 2203/45212
See application file for complete search history.

(56) References Cited

U.S. PATENT DOCUMENTS 6,970,152 B1 * 11/2005 Bell ..... G09G 3/3688 330/123
2009/0219270 A1 * 9/2009 Penev ..... G09G 3/3688 345/211

* cited by examiner

*Primary Examiner* — Nalini Mummalaneni
(74) *Attorney, Agent, or Firm* — Kile Park Reed & Houtteman PLLC

(57) ABSTRACT

The present invention relates to a technology for outputting a gamma voltage in a source driver of a display device. A gamma voltage generation circuit of a source driver in accordance with the present invention may form wide high and low gamma voltage ranges even when a negative power supply voltage and a positive power supply voltage are asymmetrical to each other.

10 Claims, 11 Drawing Sheets

GAMMA VOLTAGE GENERATION CIRCUIT OF SOURCE DRIVER

CROSS REFERENCE TO RELATED APPLICATIONS

This application is a continuation-in-part application of U.S. patent application Ser. No. 13/008,332, filed Jan. 18, 2011 (now pending), the disclosure of which is herein incorporated by reference in its entirety. The U.S. patent application Ser. No. 13/008,332 claims priority to Korean Application No. 10-2010-0004661 filed on Jan. 19, 2010, the entire contents of which are incorporated herein by reference.

BACKGROUND

1. Technical Field

The present disclosure relates to a technology for outputting a gamma voltage in a source driver of a display device, and more particular, to a gamma voltage generation circuit of a source driver, which is capable of forming a high gamma voltage range and a low gamma voltage range even when a negative power supply voltage and a positive power supply voltage are asymmetrical to each other.

2. Related Art

In general, a display device includes a source driver which drives data lines of a display panel according to R, G and B data inputted from outside.

The source driver of the display device is configured to generate gamma voltages using a positive power supply voltage and a negative power supply voltage which are provided from a power supply, and select gamma voltages corresponding to R, G, and B data in order to output a data signal.

For example, the power supply may generate a positive power supply voltage VSP, and generate a negative power supply voltage VSN using the positive power supply voltage VSP. On the other hand, the power supply may generate a negative power supply voltage VSN, and generate a positive power supply voltage VSP using the negative power supply voltage VSN.

At this time, the positive power supply voltage VSP and the negative power supply voltage VSN, which are supplied to the source driver, may be set in such a manner that the negative power supply voltage VSN has a larger absolute value or the positive supply voltage VSP has a larger absolute value, from problem like the efficiency of the circuit. As such, the positive power supply voltage VSP and the negative power supply voltage VSN, which are asymmetrical to each other based on a ground voltage GND, may be supplied to the source driver.

The positive power supply voltage VSP and the negative power supply voltage VSN may be used to generate a plurality of reference voltages, and the plurality of reference voltages may be divided into the equal numbers of high reference voltages and low reference voltages, based on an intermediate value between a positive level voltage and a negative level voltage.

Among the plurality of reference voltages, a reference voltage having the closest level to the positive power supply voltage may be referred to as the most significant high reference voltage, and a reference voltage having the closest level to the negative power supply voltage may be referred to as the most significant low reference voltage. Reference voltages having the closest voltage level to the intermediate value between the positive power supply voltage and the negative power supply voltage may be referred to as the least significant high reference voltage and the least significant low reference voltage, respectively.

The average voltage of the least significant high reference voltage and the least significant low reference voltage may be referred to as a virtual ground voltage VG.

In response to the high reference voltages, high reference gamma voltages are generated. The high reference gamma voltages may be divided to generate high gamma voltages. In response to the low reference voltages, low reference gamma voltages are generated. The low reference gamma voltages may be divided to generate low gamma voltages. The high gamma voltages may be formed in a high gamma voltage range which is defined as a higher level than the virtual ground voltage VG, and the low gamma voltages may be formed in a low gamma voltage range which is defined as a lower level than the virtual ground voltage VG. When the absolute value of the positive power supply voltage VSP supplied to the source driver is larger than the absolute value of the negative power supply voltage VSN, the virtual ground voltage VG is formed to be higher than the ground voltage GND. That is, one or more of the reference voltages included in the positive region, for example, the least significant low reference voltage may be positioned in the positive region. The least significant low reference gamma voltage and the least significant low gamma voltage, which correspond to the least significant low reference voltage, also exist in the positive region.

Gamma buffers which receive high reference voltages and stably output high reference gamma voltages are driven using the positive power supply voltage and the ground voltage, and gamma buffers which receive low reference voltages and stably output low reference gamma voltages are driven using the ground voltage and the negative power supply voltage.

However, when the least significant low reference voltage is positioned in the positive region such that a low reference voltage having a positive value is received, the corresponding gamma buffer is driven using the ground voltage GND and the negative power supply voltage VSN. Thus, the gamma buffer may have difficulties in outputting a normal low reference gamma voltage. When the high gamma voltage range and the low gamma voltage range are set to be symmetrical with each other in order to solve the above-described problem, an available gamma voltage range may be reduced.

Furthermore, when the absolute value of the negative power supply voltage VSN supplied to the source driver is higher than the absolute value of the positive power supply voltage VSP, a similar problem may also occur.

SUMMARY

Various embodiments are directed to a gamma voltage generation circuit of a source driver, which allows a gamma buffer to use an operating environment, the gamma buffer receiving a reference voltage between a ground voltage and a virtual ground voltage, when a positive power supply voltage and a negative power supply voltage are asymmetrical to each other, thereby forming wide high and low gamma voltage ranges while the high and low gamma voltage ranges are symmetrical with each other.

Also, various embodiments are directed to a gamma voltage generation circuit of a source driver, which allows a gamma buffer to use an operating environment in which a low reference voltage of a positive region can be driven, the gamma buffer receiving a low reference voltage of the positive region between a ground voltage and a virtual ground voltage, when the absolute value of a positive power supply voltage is larger than the absolute value of a negative power supply voltage, thereby forming wide high and low gamma voltage ranges while the high and low gamma voltage ranges are symmetrical with each other.

Also, various embodiments are directed to a gamma voltage generation circuit of a source driver, which allows a gamma buffer to select an operating environment in which a high reference voltage of a negative region can be driven, the gamma buffer receiving a high reference voltage of the negative region between a ground voltage and a virtual ground voltage, when the absolute value of a negative power supply voltage is larger than the absolute value of a positive power supply voltage, thereby forming wide high and low gamma voltage ranges while the high and low gamma voltage ranges are symmetrical with each other.

In an embodiment, a gamma voltage generation circuit of a source driver may include: a plurality of high gamma buffers configured to receive high reference voltages and output high reference gamma voltages, respectively; and a plurality of low gamma buffers configured to receive low reference voltages and output low reference gamma voltages, respectively. Among the low gamma buffers, the low gamma buffer receiving the least significant low reference voltage may receive the least significant low reference voltage and output the least significant low reference gamma voltage in a first operating environment using a positive power supply voltage and a ground voltage.

In an embodiment, a gamma voltage generation circuit of a source driver may include: a plurality of high gamma buffers configured to receive high reference voltages and output high reference gamma voltages, respectively; and a plurality of low gamma buffers configured to receive low reference voltages and output low reference gamma voltages, respectively. Among the high gamma buffers, the high gamma buffer receiving the least significant high reference voltage may receive the least significant high reference voltage and output the least significant high reference gamma voltage in a second operating environment using the ground voltage and a negative power supply voltage.

In an embodiment, a gamma voltage generation circuit of a source driver may include: a plurality of high gamma buffers configured to receive high reference voltages and output high reference gamma voltages, respectively; and a plurality of low gamma buffers configured to receive low reference voltages and output low reference gamma voltages, respectively. Among the low gamma buffers, the low gamma buffer receiving the least significant low reference voltage may receive the least significant low reference voltage and output the least significant low reference gamma voltage in any one selected from a first operating environment using a positive power supply voltage and a ground voltage and a second operating environment using the ground voltage and a negative power supply voltage. Among the high gamma buffers, the high gamma buffer receiving the least significant high reference voltage may receive the least significant high reference voltage and output the least significant high reference gamma voltage in any one selected from the first operating environment and the second operating environment. The low gamma buffer receiving the least significant low reference voltage and the high gamma buffer receiving the least significant high reference voltage may select the same operating environment.

DETAILED DESCRIPTION

Hereafter, embodiments of the present invention will be described in detail with reference to the accompanying drawings.

Figure 1:
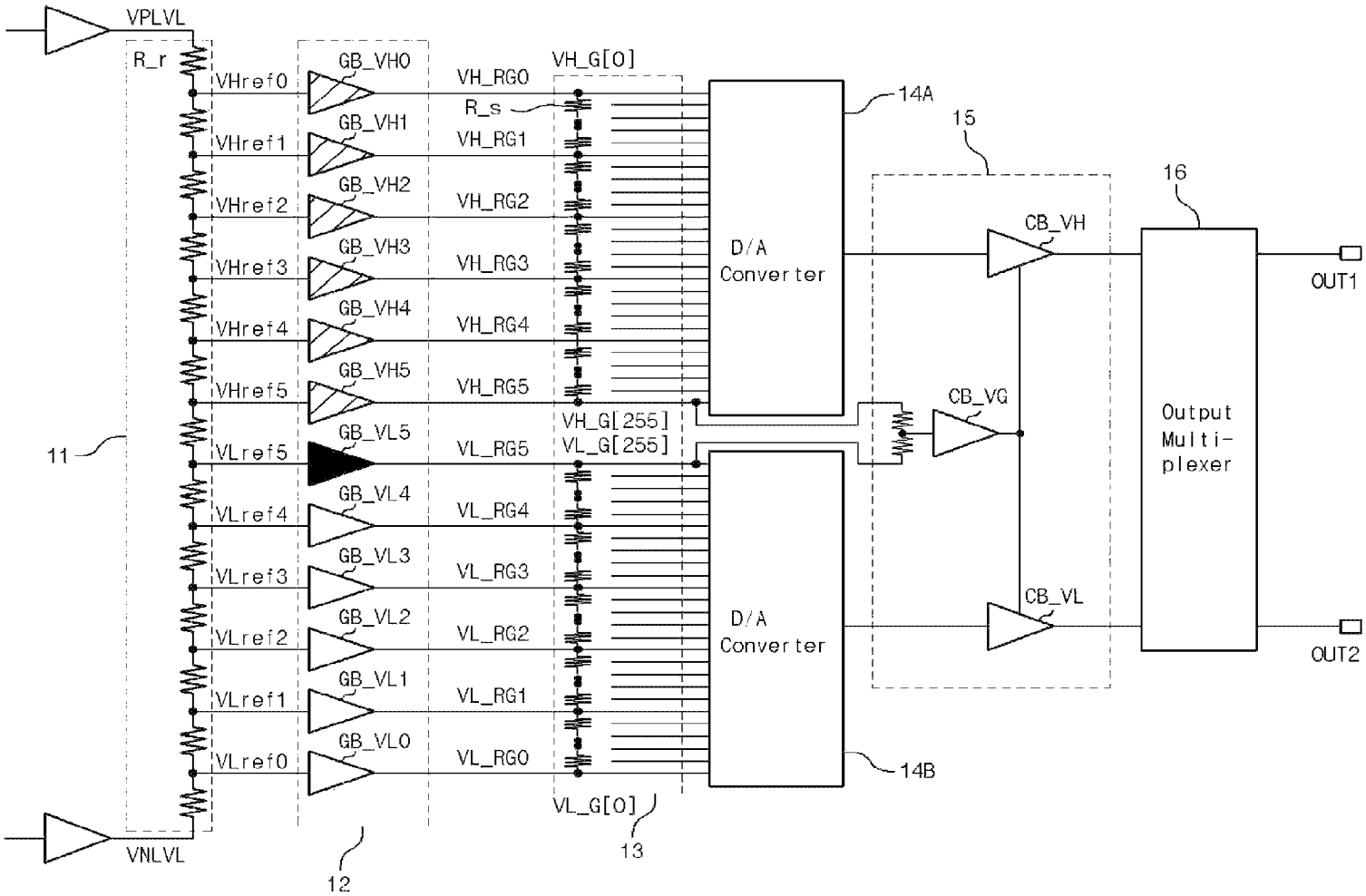
FIG. 1 is a block diagram of a gamma voltage generation circuit of a source driver in accordance with an embodiment of the present invention.

FIG. 1 is a block diagram of a gamma voltage generation circuit of a source driver in accordance with an embodiment of the present invention. The embodiment of FIG. 1 may correspond to the case in which the absolute value of a positive power supply voltage VSP is larger than the absolute value of a negative power supply voltage VSN. At this time, a positive region may be set to be wider than a negative region, and a ground voltage GND may be formed to be lower than a virtual ground voltage VG.

As illustrated in FIG. 1, the gamma voltage generation circuit of the source driver in accordance with the embodiment of the present invention may include a reference voltage generation unit 11, a gamma buffer unit 12, a gamma voltage generation unit 13, a digital/analog (D/A) converter 14A, a D/A converter 14B, a channel buffer unit 15, and an output multiplexer 16.

The reference voltage generation unit 11 may include resistors R_r coupled in series, and generate first to sixth high reference voltage VHref0 to VHref5 and first to sixth low reference voltages VLref0 to VLref5 by dividing a difference voltage between a positive level voltage VPLVL and a negative level voltage VNLVL. The positive level voltage VPLVL is the most significant voltage applied to the resistors R_r coupled in series, and a stable voltage obtained by removing noise from the positive power supply voltage VSP. The negative level voltage VNLVL is the least significant voltage applied to the resistors R_r coupled in series, and a stable voltage obtained by removing noise from the negative power supply voltage VSN.

The gamma buffer unit 12 includes first to sixth high gamma buffers GB_VH0 to GB_VH5 and first to sixth low gamma buffers GB_VL0 to GB_VL5. The first to sixth high gamma buffers GB_VH0 to GB_VH5 may receive and stabilize the first to sixth high reference voltage VHref0 to VHref5 outputted from the reference voltage generation unit 11, and output first to sixth high reference gamma voltages VH_RG0 to VH_RG5. The first to sixth low gamma buffers GB_VL0 to GB_VL5 may receive and stabilize the first to sixth low reference voltage VLref0 to VLref5, and output first to sixth low reference gamma voltages VL_RG0 to VL_RG5.

The first to sixth high gamma buffers GB_VH0 to GB_VH5 may operate as rail amplifiers in the range from the positive power supply voltage VSP to the ground voltage GND, and the first to fifth low gamma buffers GB_VL0 to GB_VL4 may operate as rail amplifiers in the range from the ground voltage GND to the negative power supply voltage VSN. The environment in which the gamma buffers operate in the range from the positive power supply voltage VSP to the ground voltage GND may be defined as a first operating environment, and the environment in which the gamma buffers operate in the range from the ground voltage GND to the negative power supply voltage VSN may be defined as a second operating environment.

In the embodiment of FIG. 1, each of the first to sixth high gamma buffers GB_VH0 to GB_VH5 may be implemented with a single buffer operating in the first operating environment, and each of the first to fifth low gamma buffers GB_VL0 to GB_VL4 may be implemented with a single buffer operating in the second operating environment. In order to indicate a difference in operating environment and configuration therebetween, each of the first to sixth high gamma buffers GB_VH0 to GB_VH5 operating in the first operating environment and implemented with a single buffer are illustrated with hatching, and each of the first to fifth low gamma buffers GB_VL0 to GB_VL4 operating in the second operating environment and implemented with a single buffer are illustrated with no hatching.

In the embodiment of FIG. 1, the sixth low gamma buffer GB_VL5 may be configured to receive the least significant sixth low reference voltage VLref5, and select any one of the first operating environment using the positive power supply voltage VSP and the ground voltage GND and the second operating environment using the ground voltage GND and the negative power supply voltage VSN. The sixth low gamma buffer GB_VL5 may receive the least significant sixth low reference voltage VLref5 and output the least significant sixth low reference gamma voltage VL_RG5 in the selected operating environment. The sixth low gamma buffer GB_VL5 capable of selecting any one of the first and second operating environments is illustrated with solid hatching to distinguish from the other gamma buffers.

In the embodiment of FIG. 1, the least significant sixth low reference voltage VLref5 may be positioned in the positive region higher than the ground voltage GND. Thus, the sixth low gamma buffer GB_VL5 may be configured to operate in the first operating environment using the positive power supply voltage VSP and the ground voltage GND in response to the low reference voltage VLref5 of the positive region, and output the low reference gamma voltage VL_RG5 of the positive region.

The gamma voltage generation unit 13 may include resistors R_s coupled in series, output first to 256th high gamma voltages VH_G[0] to VH_G[255] by dividing the first to sixth high reference voltages VHref0 to VHref5 outputted from the gamma buffer unit 12, and output first to 256th low gamma voltages VL_G[0] to VL_G[255] by dividing the first to sixth low reference voltages VLref0 to VLref5.

The D/A converter 14A may select one high gamma voltage among the first to 256th high gamma voltages VH_G[0] to VH_G[255] in response to R, G, and B data (not illustrated) inputted from a control unit (not illustrated). The D/A converter 14B may select one low gamma voltage among the first to 256th low gamma voltages VL_G[0] to VL_G[255] in response to R, G, and B data inputted from the control unit.

The channel buffer unit 15 may include a high channel buffer CB_VH, a low channel buffer CB_VL, and a virtual ground channel buffer CB_VG. The high channel buffer CB_VH may stabilize and output the high gamma voltage outputted from the D/A converter 14A. The low channel buffer CB_VL may stabilize and output the low gamma voltage outputted from the D/A converter 14B.

The virtual ground channel buffer CB_VG may receive the average voltage of the 256th high gamma voltage VH_G[255] and the 256th low gamma voltage VL_G[255], which are outputted from the gamma voltage generation unit 13, and output the received voltage as a stabilized virtual ground voltage VG. The 256th high gamma voltage VL_G [255] may correspond to the least significant high reference gamma voltage VH_RG5, and the 256th low gamma voltage VL_G[255] may correspond to the least significant reference gamma voltage VL_RG5. The high gamma voltage range and the low gamma voltage range may be set to be symmetrical with each other based on the virtual ground voltage VG. In the present embodiment, the 256th high gamma voltage VH_G[255] indicates the least significant high gamma voltage, and the 256th low gamma voltage VL_G [255] indicates the least significant low gamma voltage.

The output multiplexer 36 may switch the direction to output the high and low gamma voltages, outputted from the high channel buffer CB_VH and the low channel buffer CB_VL, to output terminals OUT1 and OUT2.

Figure 2:
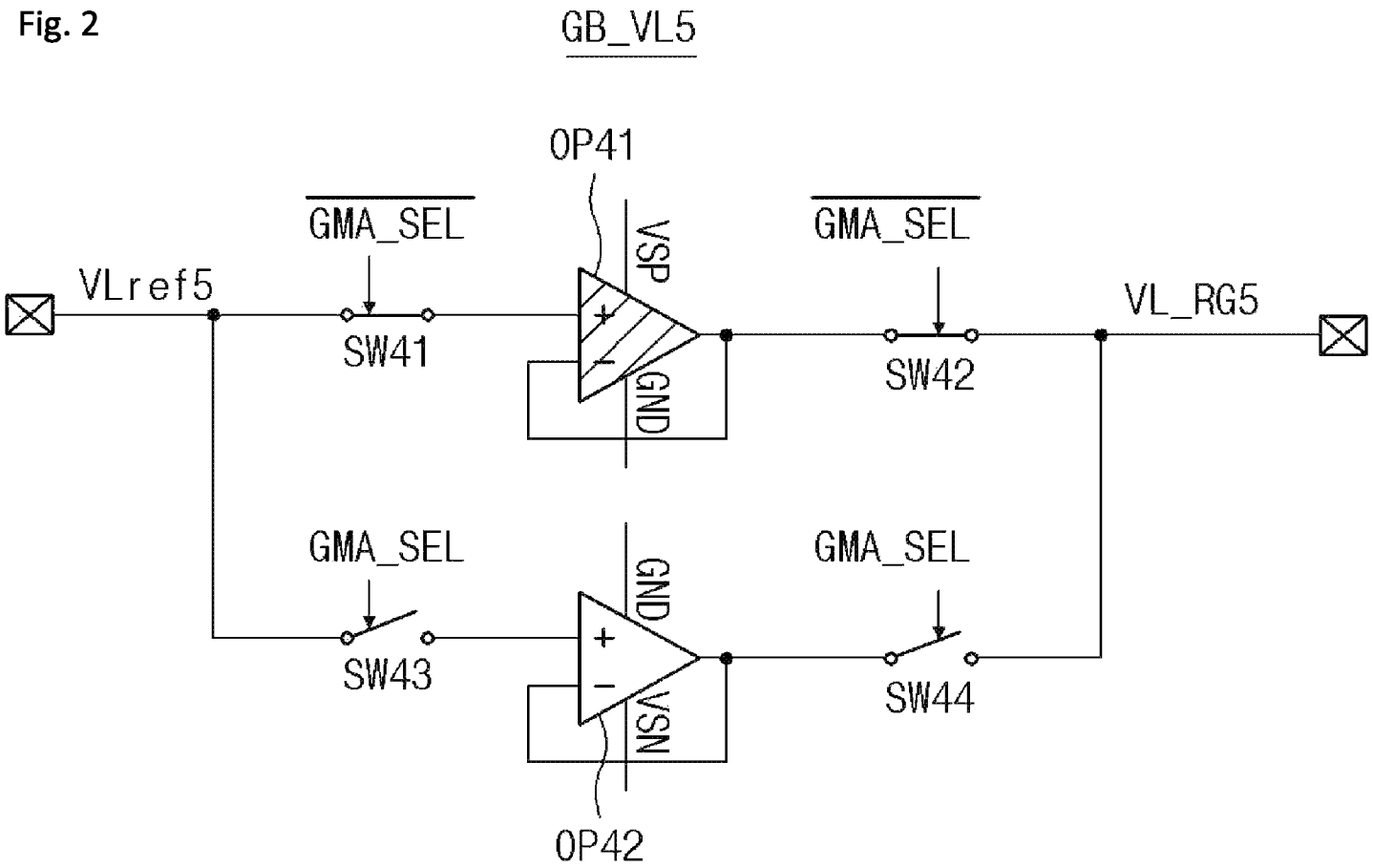
FIG. 2 is a detailed circuit diagram of a gamma buffer of FIG. 1.

The sixth gamma buffer GB_VL5 of FIG. 1 may be configured as illustrated in FIG. 2.

The sixth low gamma buffer GB_VL5 may receive the sixth low reference voltage VLref5 of the positive region, and output the sixth low reference gamma voltage VL_RG5 of the positive region. For this operation, the sixth low gamma buffer GB_VL5 may include a first buffer OP41, a second buffer OP42, and switches SW41 to SW44. That is, the sixth low gamma buffer GB_VL5 includes two buffers unlike the other gamma buffers.

The first buffer OP41 may be configured to operate in the first operating environment ranging from the positive power supply voltage VSP to the ground voltage GND, and the second buffer OP42 may be configured to operate in the second operating environment ranging from the ground voltage GND to the negative power supply voltage VSN.

The switch SW41 may be configured to transmit the sixth low reference voltage Vref5 to a non-inverting terminal (+) of the first buffer OP41 in response to an inverted gamma select signal /GMA_SEL. The switch SW42 may be configured to output an output of the first buffer OP41 as the sixth low reference gamma voltage VL_RG5 in response to the inverted gamma select signal /GMA_SEL. The switch SW43 may be configured to transmit the sixth low reference voltage VLref5 to a non-inverting terminal (+) of the second buffer OP42 in response to a gamma select signal GMA_SEL. The switch SW44 may be configured to output an output of the second buffer OP42 as the sixth low reference gamma voltage VL_RG5 in response to the gamma select signal GMA_SEL. The first and second buffer OP41 and OP42 may include an operational amplifier of which an output terminal is coupled to an inverting input terminal (−).

The logic state of the gamma select signal GMA_SEL is changed when the sixth low reference voltage VLref5 is included in the positive region or when the sixth low reference voltage VLref5 is included in the negative region. The gamma select signal GMA_SEL has the opposite polarity to the inverted gamma select signal /GMA_SEL.

In the embodiments of FIGS. 1 and 2, when the absolute value of the positive power supply voltage VSP is larger than the absolute value of the negative power supply voltage VSN (|VSP|>|VSN|), the sixth low gamma buffer GB_VL5 may receive the sixth low reference voltage Vref5 positioned in the positive region, and receive the gamma select signal GAM_SEL disabled to a low level. Thus, the sixth low gamma buffer GB_VL5 may transmit the sixth low reference voltage VLref5 to the first buffer OP41 through the turned-on switch SW41 in response to the inverted gamma select signal /GAM_SEL enabled to a high level, and output the output of the first buffer OP41 as the sixth low reference gamma voltage VL_RG5 through the turned-on switch SW42.

Figure 3:
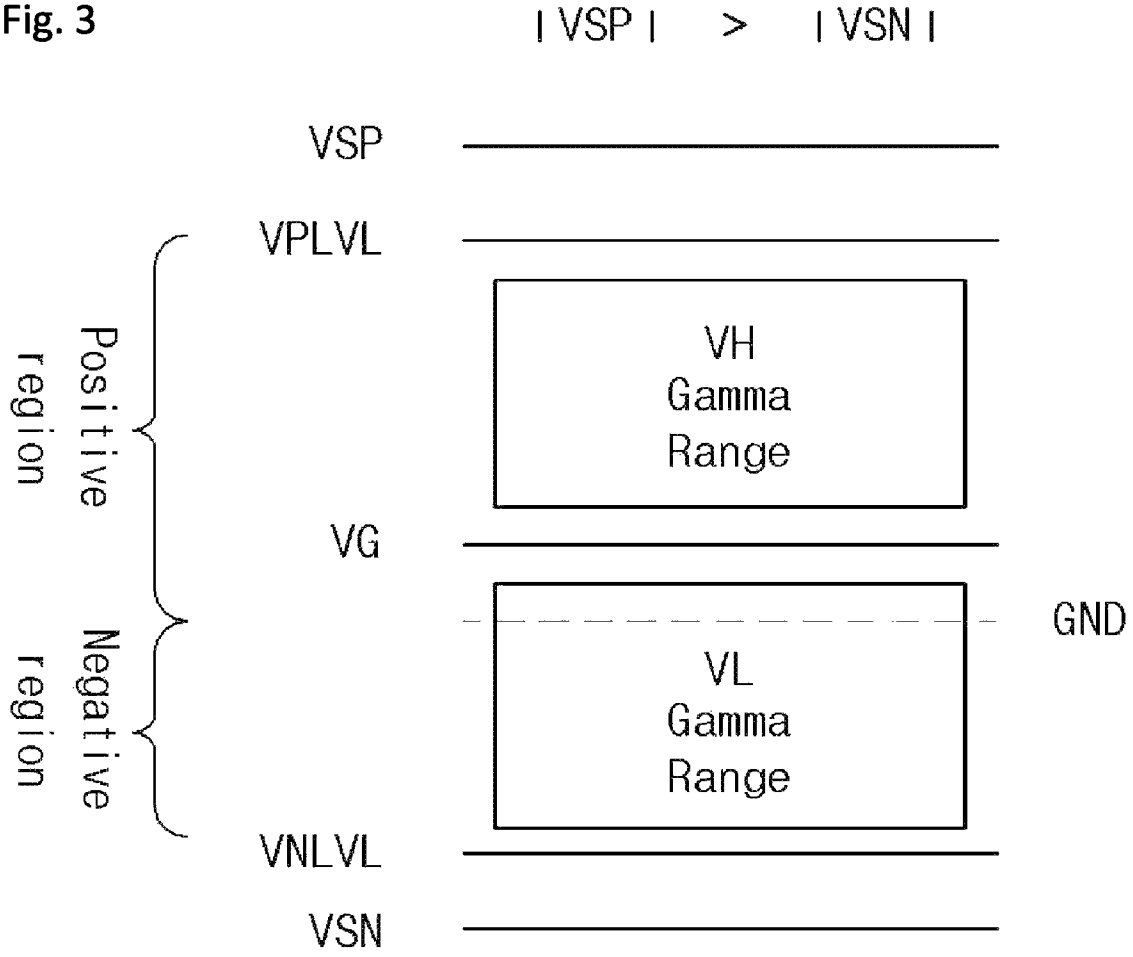
FIG. 3 illustrates the relation between voltages used in the source driver, when the absolute value of a positive power supply voltage is larger than the absolute value of a negative power supply voltage.

As illustrated in FIG. 3, when the absolute value of the positive power supply voltage VSP is larger than the absolute value of the negative power supply voltage VSN and the ground voltage GND for distinguishing between the positive region and the negative region is formed to be lower than the virtual ground voltage VG, the sixth low gamma buffer GB_VL5 in the embodiments of FIGS. 1 and 2 may be operated by the first buffer OP41 operating in the first operating environment.

The sixth low gamma buffer GB_VL5 may output the sixth reference gamma voltage VL_RG5 of the positive region in response to the sixth low reference voltage VLref5 of the positive region. As a result, the gamma voltage range may be symmetrically and widely used.

The embodiment of FIG. 1 corresponds to the case in which the absolute value of the positive power supply voltage VSP is larger than the absolute value of the negative power supply voltage VSN. However, the embodiment of FIG. 1 may be operated even in the case in which the absolute value of the positive power supply voltage VSP is equal to the absolute value of the negative power supply voltage VSN.

Figure 4:
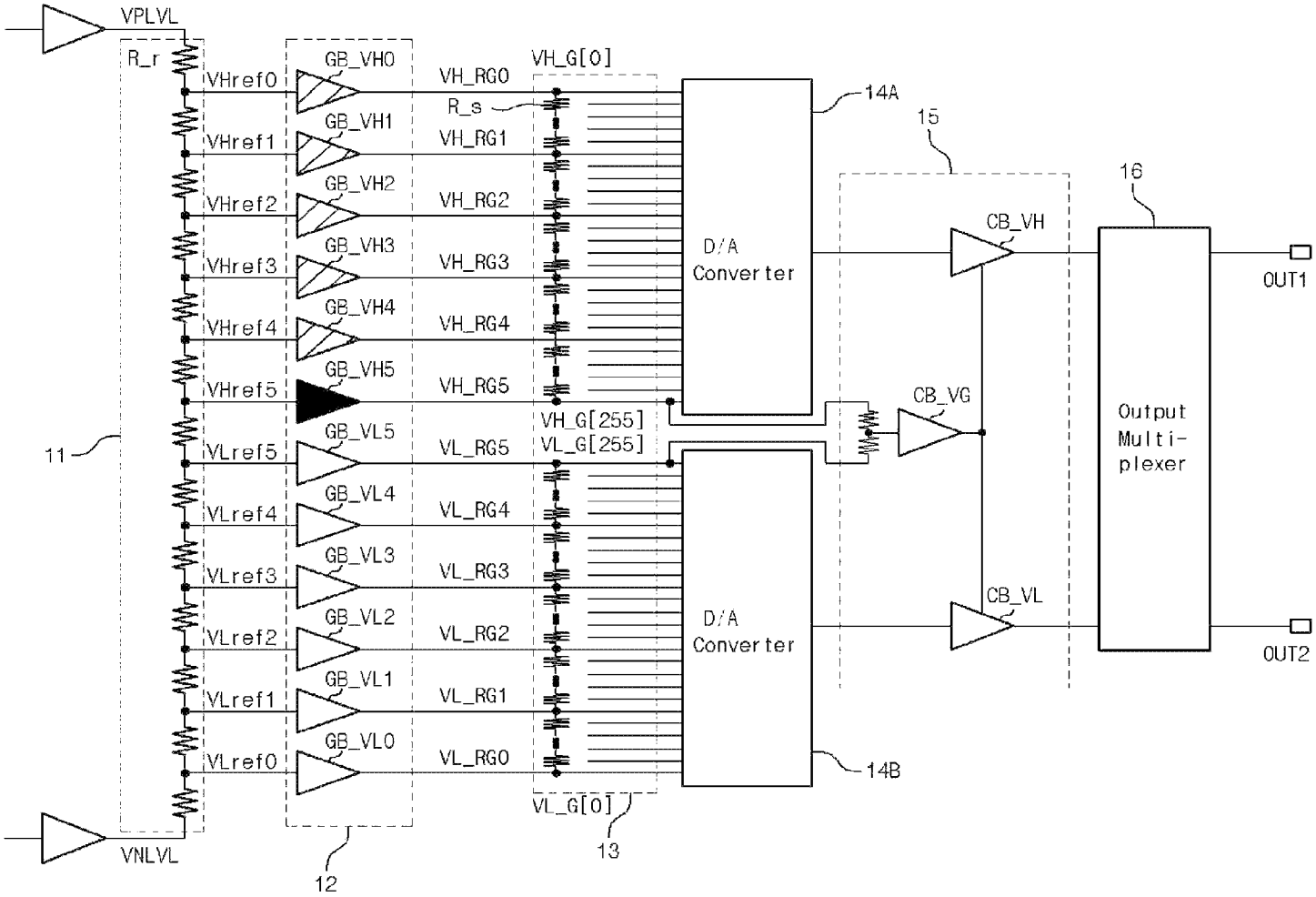
FIG. 4 is a block diagram of a gamma voltage generation circuit of a source driver in accordance with another embodiment of the present invention.

FIG. 4 is a block diagram of a gamma voltage generation circuit of a source driver in accordance with another embodiment of the present invention. The embodiment of FIG. 4 corresponds to the case in which the absolute value of the negative power supply voltage VSN is larger than the absolute value of the positive power supply voltage VPN. At this time, the negative region is formed to be wider than the positive region, and the ground voltage GND is formed to be lower than the virtual ground voltage VG.

The embodiment of FIG. 4 may have substantially the same configuration as the embodiment of FIG. 1, except that the least significant high gamma buffer GB_VH5 and the least significant low gamma buffer GB_VL5 are configured in a different manner from those of FIG. 1. Thus, the duplicated descriptions of the configuration and operation thereof are omitted herein. The first to fifth high gamma buffers GB_VH0 to GB_VH4 may operate as rail amplifiers in the first operating environment, and the first to sixth low gamma buffers GB_VL0 to GB_VL5 may operate as rail amplifiers in the second operating environment.

In the embodiment of FIG. 4, each of the first to fifth high gamma buffers GB_VH0 to GB_VH4 may be implemented with a single buffer operating in the first operating environment, and each of the first to sixth low gamma buffers GB_VL0 to GB_VL5 may be implemented with a single buffer operating in the second operating environment. In order to indicate a difference in operating environment and configuration therebetween, each of the first to fifth high gamma buffers GB_VH0 to GB_VH4 operating in the first operating environment and implemented with a single buffer are illustrated with hatching, and each of the first to sixth low gamma buffers GB_VL0 to GB_VL5 operating in the second operating environment and implemented with a single buffer are illustrated with no hatching.

In the embodiment of FIG. 4, the sixth low gamma buffer GB_VL5 may be configured to receive the least significant sixth low reference voltage VLref5, and select any one of the first operating environment and the second operating environment. The sixth low gamma buffer GB_VL5 may receive the least significant sixth high reference voltage VHref5 and output the least significant sixth high reference gamma voltage VH_RG5 in the selected operating environment. The sixth low gamma buffer GB_VL5 capable of selecting any one of the first and second operating environments is illustrated with solid hatching to distinguish from the other gamma buffers.

In the embodiment of FIG. 4, the least significant sixth low reference voltage VLref5 may be positioned in the negative region lower than the ground voltage GND. Thus, the sixth low gamma buffer GB_VL5 may be configured to operate in the first operating environment in response to the sixth high reference voltage VHref5 of the negative region, and output the sixth high reference gamma voltage VH_RG5 of the negative region.

Figure 5:
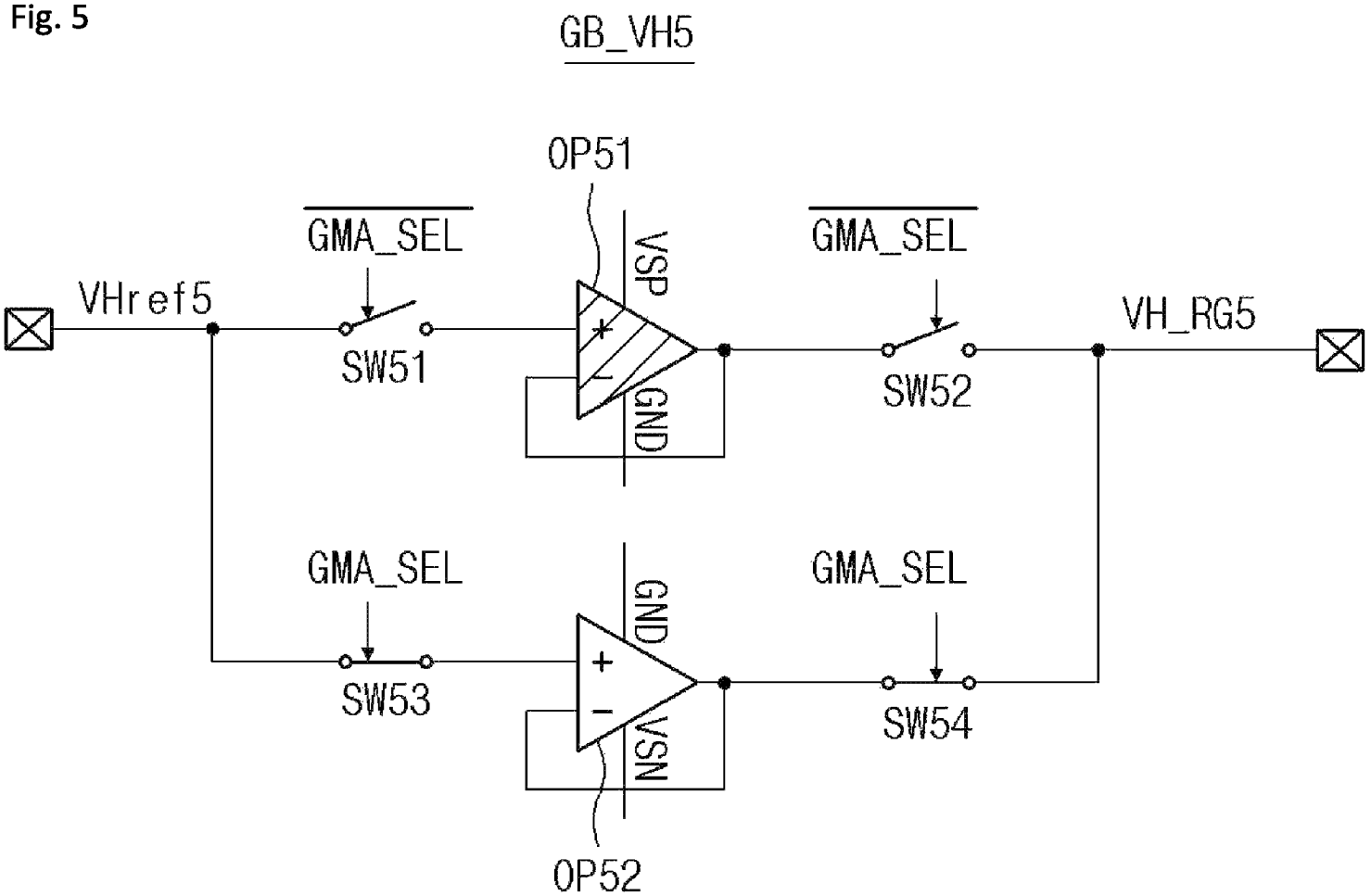
FIG. 5 is a detailed circuit diagram of a gamma buffer of FIG. 4.

The sixth high gamma buffer GB_VH5 of FIG. 4 may be configured as illustrated in FIG. 5.

The sixth high gamma buffer GB_VH5 may receive the sixth high reference voltage VHref5 of the negative region, and output the sixth high reference gamma voltage VH_RG5 of the negative region. For this operation, the sixth high gamma buffer GB_VH5 may include a third buffer OP51, a fourth buffer OP52, and switches SW51 to SW54. That is, the sixth high gamma buffer GB_VH5 includes two buffers unlike the other gamma buffers.

The third buffer OP51 may be configured to operate in the first operating environment, and the fourth buffer OP52 may be configured to operate in the second operating environment.

The switch SW51 may be configured to transmit the sixth high reference voltage VHref5 to a non-inverting terminal (+) of the third buffer OP51 in response to the inverted gamma select signal /GMA_SEL. The switch SW52 may be configured to output an output of the third buffer OP51 as the sixth high reference gamma voltage VH_RG5 in response to the inverted gamma select signal /GMA_SEL. The switch SW53 may be configured to transmit the sixth high reference voltage VHref5 to a non-inverting terminal (+) of the fourth buffer OP52 in response to the gamma select signal GMA_SEL. The switch SW54 may be configured to output an output of the fourth buffer OP52 as the sixth high reference gamma voltage VH_RG5 in response to the gamma select signal GMA_SEL. The third and fourth buffers OP51 and OP52 may include an operational amplifier of which an output terminal is coupled to an inverting input terminal (−).

The gamma select signal GMA_SEL has a logic state which is changed when the sixth high reference voltage VHref5 is included in the positive region or when the sixth high reference voltage VHref5 is included in the negative region, and has the opposite polarity to the inverted gamma select signal /GMA_SEL.

In the embodiments of FIGS. 4 and 5, when the absolute value of the negative power supply voltage VSN is larger than the absolute value of the positive power supply voltage VSP (|VSN|>|VSP|), the sixth high gamma buffer GB_VH5 may receive the sixth high reference voltage VHref5 positioned in the negative region, and receive the gamma select signal GAM_SEL enabled to the high level. Thus, the sixth high gamma buffer GB_VH5 may transmit the sixth high reference voltage VHref5 to the fourth buffer OP52 through the turned-on switch SW53 in response to the gamma select signal GAM_SEL enabled to the high level, and output an output of the fourth buffer OP52 to the sixth high reference gamma voltage VH_RG5 through the turned-on switch SW54.

Figure 6:
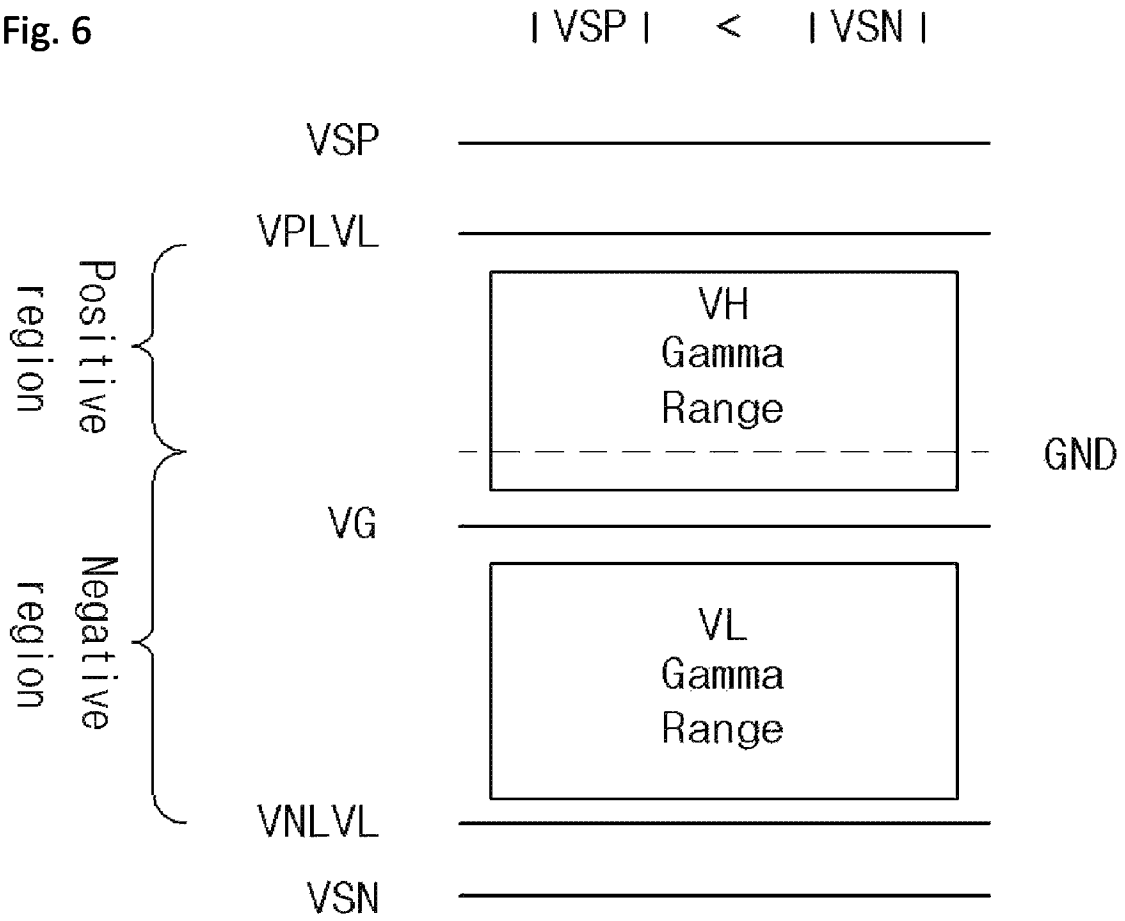
FIG. 6 illustrates the relation between voltages used in the source driver, when the absolute value of a positive power supply voltage is larger than the absolute value of a negative power supply voltage.

As illustrated in FIG. 6, when the absolute value of the negative power supply voltage VSN is larger than the absolute value of the positive power supply voltage VSP and the ground voltage GND for distinguishing between the positive region and the negative region is formed to be higher than the virtual ground voltage VG, the sixth high gamma buffer GB_VH5 in the embodiments of FIGS. 4 and 5 may be operated by the fourth buffer OP52 operating in the second environment.

The sixth high gamma buffer GB_VH5 may output the sixth high reference gamma voltage VH_RG5 of the negative region in response to the sixth high reference voltage VHref5 of the negative region. As a result, the gamma voltage range may be symmetrically and widely used. In accordance with the embodiment of the present invention, the gamma voltage generation circuit of the source driver may be manufactured as described in the embodiments of FIGS. 1 to 6, and the state of a gamma voltage may be determined to select a buffer. That is, when the absolute value of the positive power supply voltage VSP and the absolute value of the negative power supply voltage VSN are formed to be asymmetrical to each other, the gamma voltage generation circuit of the source driver in accordance with the embodiment of the present invention may change the switching state to use the first buffer (the third buffer) or the second buffer (the fourth buffer).

Thus, the gamma voltage generation circuit in accordance with the embodiment of the present invention may flexibly deal with the voltage environment in the source driver.

The embodiment of FIG. 4 corresponds to the case in which the absolute value of the negative power supply voltage VSN is larger than the absolute value of the positive power supply voltage VSP. However, the embodiment of FIG. 1 may be operated even in the case in which the absolute value of the negative power supply voltage VSN is equal to the absolute value of the positive power supply voltage VSP.

Figure 7:
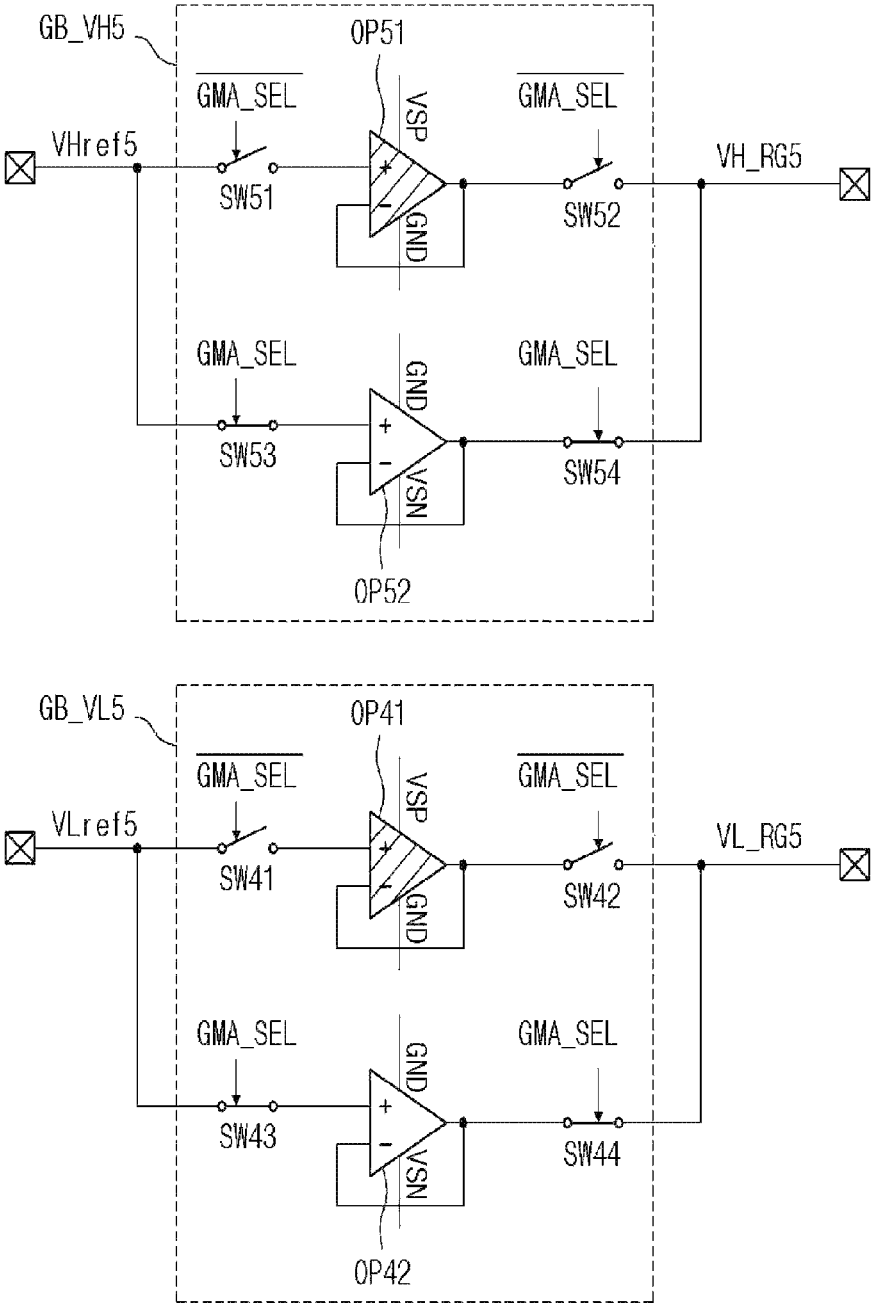
FIG. 7 is a detailed circuit diagram illustrating another example of a sixth low gamma buffer and a sixth high gamma buffer of the embodiments of FIGS. 1 and 4.

Furthermore, the sixth low gamma buffer GB_VL5 and the sixth high gamma buffer GB_VH5 of the embodiments of FIGS. 1 and 4 may be applied as illustrated in FIG. 7.

FIG. 7 illustrates that the sixth low gamma buffer GB_VL5 has the configuration of FIG. 2 and the sixth high gamma buffer GB_VH5 has the configuration of FIG. 5.

In the embodiment of FIG. 7, the gamma voltage generation circuit of the source driver may be manufactured, and the state of a gamma voltage may be determined to select a buffer.

In the embodiment of FIG. 7, when the absolute value of the positive power supply voltage VSP is larger than the absolute value of the negative power supply voltage VSN (|VSP|>|VSN|), the gamma select signal GAM_SEL disabled to a low level may be received. As a result, both of the sixth low gamma buffer GB_VL5 and the sixth high gamma buffer GB_VH5 may be set to operate in the first operating environment.

In the embodiment of FIG. 7, when the absolute value of the negative power supply voltage VSN is larger than the absolute value of the positive power supply voltage VSP, the gamma select signal GAM_SEL enabled to a high level may be received. As a result, both of the sixth low gamma buffer GB_VL5 and the sixth high gamma buffer GB_VH5 may be set to operate in the second operating environment.

Figure 8:
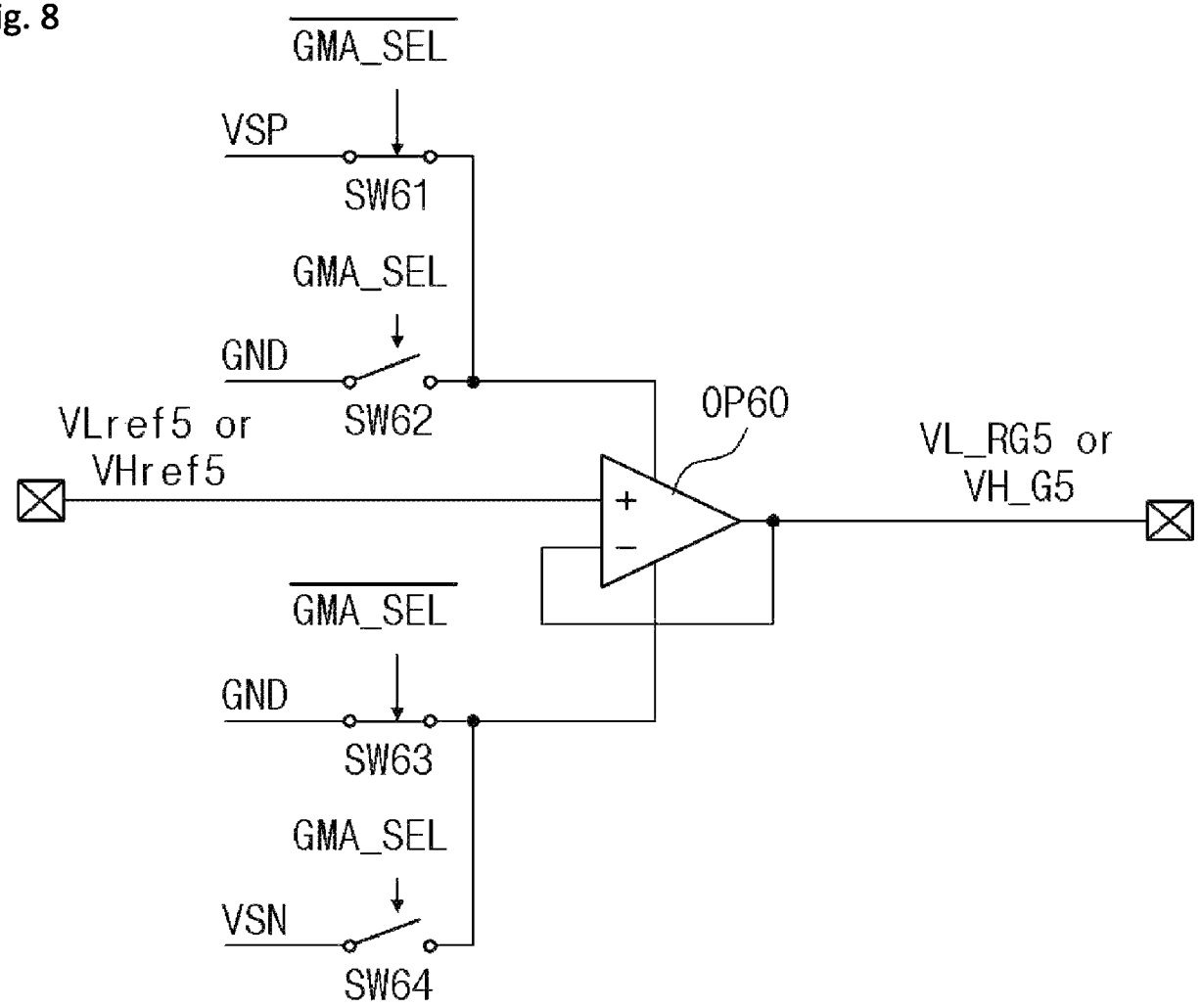
FIG. 8 is a detailed circuit diagram illustrating another example of the sixth low gamma buffer or the sixth high gamma buffer of the embodiment of FIG. 1 or 4.

Furthermore, the sixth low gamma buffer GB_VL5 illustrated as the embodiment of FIG. 1 and the sixth high gamma buffer GB_VH5 illustrated as the embodiment of in FIG. 4 may be implemented with a single buffer as illustrated in FIG. 8.

In the following descriptions, suppose that an embodiment of FIG. 8 is applied to the sixth low gamma buffer GB_VL5 of FIG. 1.

As illustrated in FIG. 8, the sixth low gamma buffer GB_VL5 may include a buffer OP60 and switches SW61 to SW64.

The buffer OP60 may be configured to receive the sixth low reference voltage VLref6 and output the sixth low reference gamma voltage VL_RG5.

The switches SW61 and SW63 may be turned on in response to the enabled inverted gamma select signal /GMA_SEL, and the switches SW62 and SW64 may be turned on in response to the enabled gamma select signal GMA_SEL. Furthermore, the switch SW61 may be configured to transmit the positive power supply voltage VSP to the buffer OP60, the switch SW62 may be configured to transmit the ground voltage GND to the buffer OP60, the switch SW63 may be configured to transmit the ground voltage GND to the buffer OP60, and the switch SW64 may be configured to transmit the negative power supply voltage VSN to the buffer OP60.

First, when the absolute value of the positive power supply voltage VSP is larger than the absolute value of the negative power supply voltage VSN, the switches SW61 and SW63 may be turned on. At this time, the switches SW62 and SW64 may be turned off. Thus, the buffer OP60 may operate in the first operating environment ranging from the positive power supply voltage VSP to the ground voltage GND.

In the following descriptions, suppose that the embodiment of FIG. 8 is applied to the sixth high gamma buffer GB_VH5 of FIG. 3.

When the absolute value of the negative power supply voltage VSN is larger than the absolute value of the positive power supply voltage VSP, the switches SW62 and SW64 may be turned on. At this time, the switches SW61 and SW63 may be turned off. Thus, the buffer OP60 may operate in the second operating environment ranging from the ground voltage GND to the negative power supply voltage VNP.

As such, in the embodiment of FIG. 8, after the gamma voltage generation circuit of the source driver is manufactured, the state of a gamma voltage may be determined to select an operating environment.

In the present embodiment, it has been described that when the absolute value of the positive power supply voltage VSP is asymmetrical to the absolute value of the negative power supply voltage VSN (|VSP|>|VSN| or |VSP|<|VSN|), the sixth high gamma buffer GB_VH6 and the sixth low gamma buffer GB_VL1 are set to the gamma buffers which are operated in the vicinity of the boundary region between the high gamma voltage range and the low gamma voltage range. However, the present invention is not limited thereto, but the fifth high gamma buffer GB_VH5 and the fifth low gamma buffer GB_VL2 may also be set to the gamma buffers which are operated in the vicinity of the boundary region between the high gamma voltage range and the low gamma voltage range, according to a difference between the ground voltage GND and the virtual ground voltage VG.

Furthermore, the sixth low gamma buffer GB_VL5 illustrated as the embodiment of FIG. 1 and the sixth high gamma buffer GB_VH5 illustrated as the embodiment of in FIG. 4 may be set to operate in a third operating environment using the positive power supply voltage VSP and the negative power supply voltage VSN.

Figure 9:
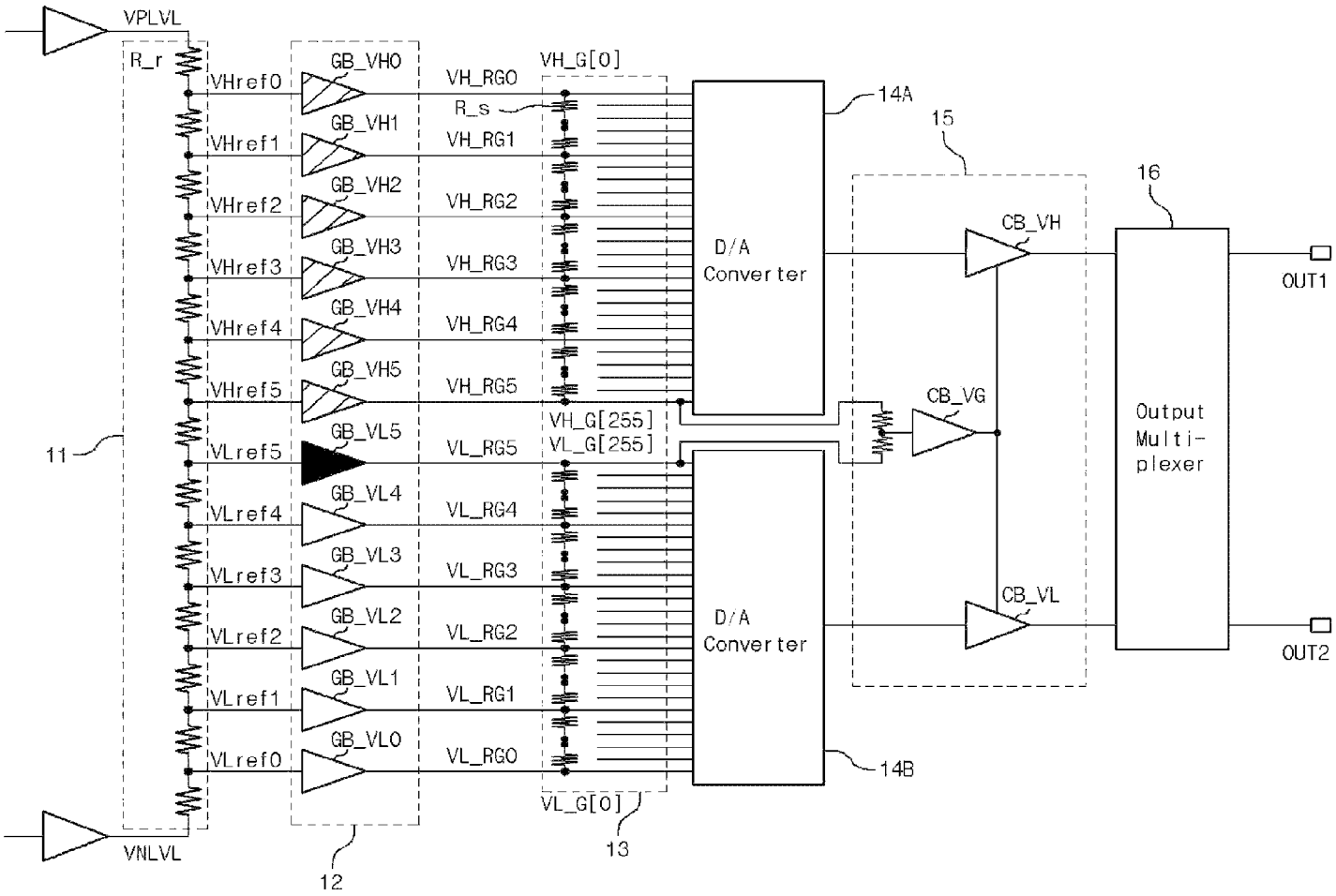
FIG. 9 is a block diagram illustrating a gamma voltage generation circuit of a source driver in accordance with another embodiment of the present invention.
Figure 10:
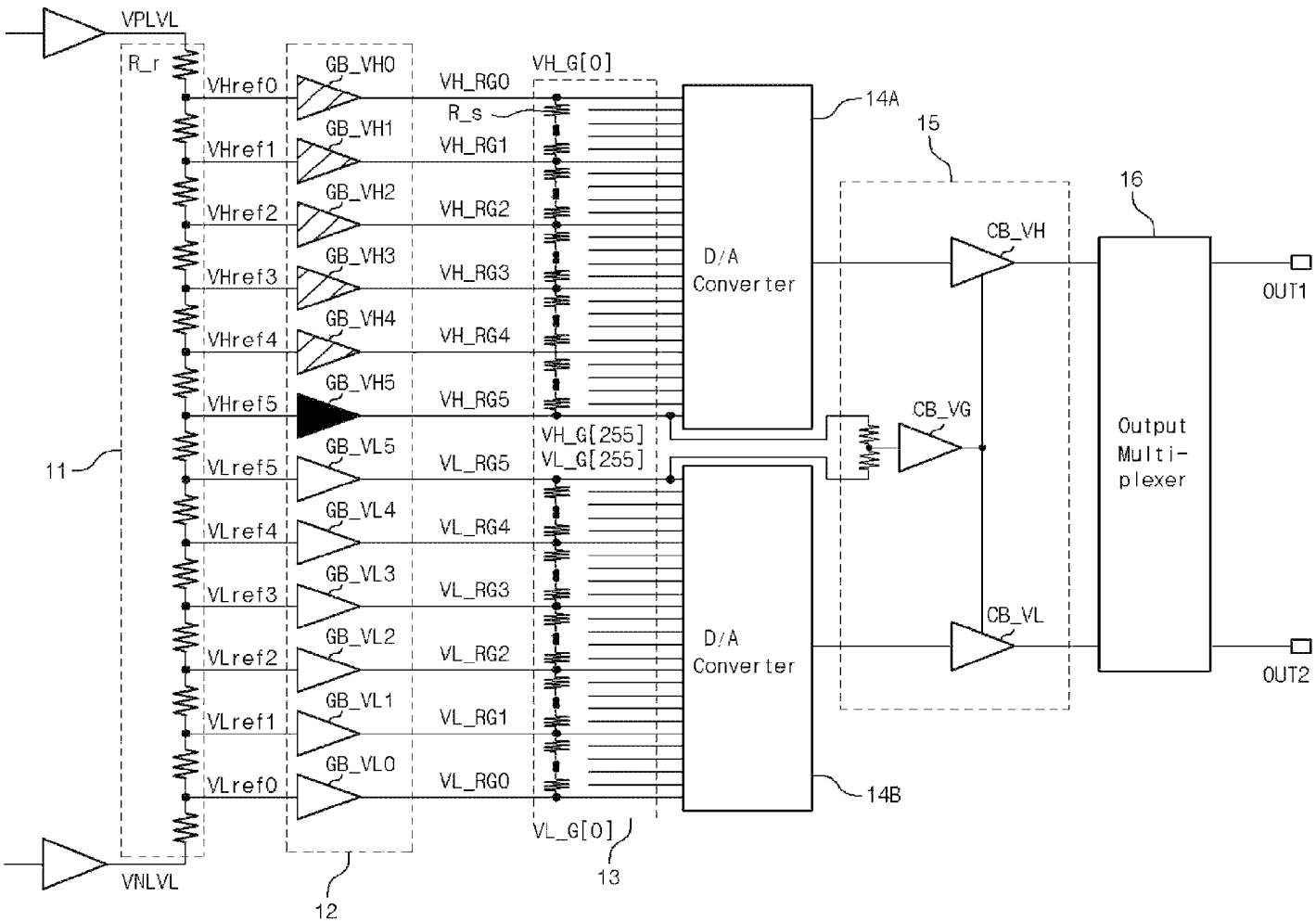
FIG. 10 is a block diagram illustrating a gamma voltage generation circuit of a source driver in accordance with another embodiment of the present invention.

FIG. 9 illustrates that the sixth low gamma buffer GB_VL5 is configured to operate in the third operating environment. FIG. 10 illustrates that the sixth high gamma buffer GB_VH5 is configured to operate in the third operating environment. The sixth low gamma buffer GB_VL5 and the sixth high gamma buffer GB_VH5 of FIGS. 9 and 10 may be configured as illustrated in FIG. 11.

Figure 11:
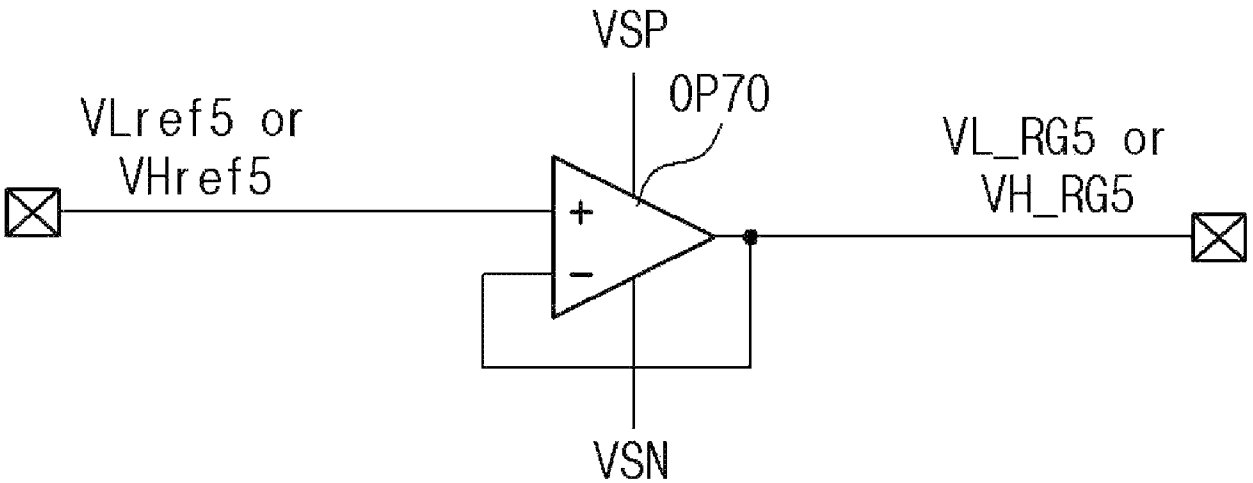
FIG. 11 is a detailed diagram illustrating another example of a gamma buffer of FIG. 9 or a gamma buffer of FIG. 10.

Referring to FIG. 11, a buffer OP70 may be driven using the positive power supply voltage VSP and the negative power supply voltage VSN.

According to the configuration of FIG. 11, although the sixth low reference voltage VLref5 of the positive region is applied or the sixth high reference voltage VHref5 of the negative region is applied, the buffer OP70 may output the sixth low reference gamma voltage VL_RG5 of the positive region or the sixth high reference gamma voltage VH_RG5 of the negative region in response to an input voltage.

The gamma voltage output circuit of the source driver in accordance with the embodiment of the present invention may use a wide gamma voltage range when the low gamma voltage range and the high gamma voltage range are set to be symmetrical with each other. Thus, the gamma voltage output circuit may be applied to an IPS (In-Plane Switching) LCD or VA (Vertical Alignment) LCD which requires a wide gamma voltage range. However, the gamma voltage output circuit of the source driver in accordance with the embodiment of the present invention may not be limited to LCD panels, but applied to other FPDs (Flat Panel Displays) such as OLED (Organic Light Emitting Diode).

In accordance with the embodiment of the present invention, when the absolute value of the positive power supply voltage and the absolute value of the negative power supply voltage are asymmetrical to each other, the gamma buffer receiving the reference voltage between the ground voltage and the virtual ground voltage may select the operating environment, thereby forming wide high and low gamma voltage ranges while the high and low gamma voltage ranges are symmetrical with each other.

While various embodiments have been described above, it will be understood to those skilled in the art that the embodiments described are by way of example only. Accordingly, the disclosure described herein should not be limited based on the described embodiments.

What is claimed is:

1. A gamma voltage generation circuit of a source driver, comprising:

a plurality of high gamma buffers configured to receive high reference voltages and output high reference gamma voltages, respectively; and a plurality of low gamma buffers configured to receive low reference voltages and output low reference gamma voltages, respectively, wherein a positive region and a negative region are divided based on a ground voltage, a first low gamma buffer included in the low gamma buffers receives a first low reference voltage between the ground voltage and a virtual ground voltage in the positive region when a positive power supply voltage and a negative power supply voltage are asymmetrical to each other and outputs a first low reference gamma voltage, the high gamma buffers are operated in a first operating environment using a positive driving voltage and the ground voltage, the low gamma buffers excluding the first low gamma buffer are operated in a second operating environment using the ground voltage and a negative driving voltage, and the first low gamma buffer is operated in the first operating environment according to a gamma select signal in a first logic state corresponding to a case in which the first low reference voltage is between the ground voltage and the virtual ground voltage in the positive region, and operated in the second operating environment according to the gamma select signal in a second logic state corresponding to a case in which the first low reference voltage belongs to the negative region.

2. The gamma voltage generation circuit of claim 1, wherein the first low gamma buffer comprises:

a first buffer configured to operate in the first operating environment;

a second buffer configured to operate in the second operating environment;

a first switch configured to transmit the first low reference voltage to the first buffer according to the gamma select signal in the first logic state, in a first case where the absolute value of the positive power supply voltage is equal to or more than the absolute value of the negative power supply voltage;

a second switch configured to output an output of the first buffer as the first low reference gamma voltage according to the gamma select signal in the first logic state, in the first case;

a third switch configured to transmit the first low reference voltage to the second buffer according to the gamma select signal in the second logic state, in a second case where the absolute value of the positive power supply voltage is less than the absolute value of the negative power supply voltage; and a fourth switch configured to output an output of the second buffer as the first low reference gamma voltage according to the gamma select signal in the second logic state, in the second case.

3. The gamma voltage generation circuit of claim 1, wherein the first low gamma buffer comprises:

a buffer configured to receive the first low reference voltage and output the first low reference gamma voltage;

a first switch configured to transmit the positive power supply voltage to the buffer for the first operating environment according to the gamma select signal in the first logic state, in a first case where the absolute value of the positive power supply voltage is equal to or more than the absolute value of the negative power supply voltage;

a second switch configured to transmit the ground voltage to the buffer for the second operating environment according to the gamma select signal in the second logic state, in a second case where the absolute value of the positive power supply voltage is less than the absolute value of the negative power supply voltage;

a third switch configured to transmit the ground voltage to the buffer for the first operating environment according to the gamma select signal in the first logic state, in the first case; and a fourth switch configured to transmit the negative power supply voltage to the buffer for the second operating environment according to the gamma select signal in the second logic state, in the second case.

4. The gamma voltage generation circuit of claim 1, wherein the virtual ground voltage is an average voltage of the least significant high reference voltage and the least significant low reference voltage.

5. A gamma voltage generation circuit of a source driver, comprising:

a plurality of high gamma buffers configured to receive high reference voltages and output high reference gamma voltages, respectively; and a plurality of low gamma buffers configured to receive low reference voltages and output low reference gamma voltages, respectively, wherein a positive region and a negative region are divided based on a ground voltage, a first high gamma buffer included in the high gamma buffers receives a first high reference voltage between the ground voltage and a virtual ground voltage in the negative region when a positive power supply voltage and a negative power supply voltage are asymmetrical to each other and outputs a first high reference gamma voltage, the high gamma buffers excluding the first high gamma buffer are operated in a first operating environment using a positive driving voltage and the ground voltage, the low gamma buffers are operated in a second operating environment using the ground voltage and a negative driving voltage, and the first high gamma buffer is operated in the first operating environment according to a gamma select signal in a first logic state corresponding to a case in which the first high reference voltage belongs to the positive region, and operated in the second operating environment according to the gamma select signal in a second logic state corresponding to a case in which the first high reference voltage is between the ground voltage and the virtual ground voltage the negative region.

6. The gamma voltage generation circuit of claim 5, wherein the first high gamma buffer comprises:

a first buffer configured to operate in the first operating environment;

a second buffer configured to operate in the second operating environment;

a first switch configured to transmit the first high reference voltage to the second buffer according to the gamma select signal in the first logic state, in a first case where the absolute value of the negative power supply voltage is less than the absolute value of the positive power supply voltage;

a second switch configured to output an output of the second buffer as the first high reference gamma voltage according to the gamma select signal in the first logic state, in the first case;

a third switch configured to transmit the first high reference voltage to the second buffer according to the gamma select signal in the second logic state, in a second case where the absolute value of the negative power supply voltage is equal to or more than the absolute value of the positive power supply voltage; and a fourth switch configured to output an output of the second buffer as the first high reference gamma voltage according to the gamma select signal in the second logic state, in the second case.

7. The gamma voltage generation circuit of claim 5, wherein the first high gamma buffer comprises:

a buffer configured to receive the first high reference voltage and output the second high reference gamma voltage;

a first switch configured to transmit the positive power supply voltage to the buffer for the first operating environment according to the gamma select signal in the first logic state, in a first case where the absolute value of the negative power supply voltage is less than the absolute value of the positive power supply voltage;

a second switch configured to transmit the ground voltage to the buffer for the second operating environment according to the gamma select signal in the second logic state, in a second case where the absolute value of the negative power supply voltage is equal to or more than the absolute value of the positive power supply voltage;

a third switch configured to transmit the ground voltage to the buffer for the first operating environment according to the gamma select signal in the first logic state, in the first case; and a fourth switch configured to transmit the negative power supply voltage to the buffer for the second operating environment according to the gamma select signal in the second logic state, in the second case.

8. The gamma voltage generation circuit of claim 5, wherein the virtual ground voltage is an average voltage of the least significant high reference voltage and the least significant low reference voltage.

9. A gamma voltage generation circuit of a source driver, comprising:

a plurality of high gamma buffers configured to receive high reference voltages and output high reference gamma voltages, respectively; and a plurality of low gamma buffers configured to receive low reference voltages and output low reference gamma voltages, respectively, wherein a positive region and a negative region are divided based on a ground voltage, a first low gamma buffer included in the low gamma buffers receives a first low reference voltage and outputs a first low reference gamma voltage, and a first high gamma buffer included in the high gamma buffers receives a first high reference voltage and outputs a first high reference gamma voltage, wherein the high gamma buffers excluding the first high gamma buffer are operated in a first operating environment using a positive driving voltage and a ground voltage, wherein the low gamma buffers excluding the first low gamma buffer are operated in a second operating environment using the ground voltage and a negative driving voltage, wherein the first low gamma buffer is operated in the first operating environment according to a gamma select signal in a first logic state corresponding to a case in which the first low reference voltage is between the ground voltage and a virtual ground voltage in the positive region when the positive power supply voltage and the negative power supply voltage are asymmetrical to each other, and operated in the second operating environment according to the gamma select signal in a second logic state corresponding to a case in which the first low reference voltage belongs to the negative region, and wherein the first high gamma buffer is operated in the first operating environment according to the gamma select signal in the first logic state corresponding to a case in which the first high reference voltage belongs to the positive region, and operated in the second operating environment according to the gamma select signal in the second logic state corresponding to a case in which the first high reference voltage is between the ground voltage and the virtual ground voltage in the negative region when the positive power supply voltage and the negative power supply voltage are asymmetrical to each other.

10. The gamma voltage generation circuit of claim 9, wherein the virtual ground voltage is an average voltage of the least significant high reference voltage and the least significant low reference voltage.

* * * * *